US006554398B2

(12) United States Patent
Wyngaert et al.

(10) Patent No.: US 6,554,398 B2
(45) Date of Patent: Apr. 29, 2003

(54) INK-JET PRINTER EQUIPPED FOR ALIGNING THE PRINTHEADS

(75) Inventors: Hilbrand Vanden Wyngaert, Grobbendonk (BE); Bart Verhoest, Niel (BE); Dirk De Ruijter, Deurne (BE); Bart Verlinden, Tongeren (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/079,981

(22) Filed: Feb. 21, 2002

(65) Prior Publication Data

US 2002/0126169 A1 Sep. 12, 2002

Related U.S. Application Data

(60) Provisional application No. 60/292,582, filed on May 22, 2001.

(30) Foreign Application Priority Data

Mar. 8, 2001 (EP) ..... 01000045

(51) Int. Cl.[7] ..... B41J 2/155
(52) U.S. Cl. ..... 347/42; 347/13; 347/19
(58) Field of Search ..... 347/42, 13, 19, 347/14, 16

(56) References Cited

U.S. PATENT DOCUMENTS

| | | | | |
|---|---|---|---|---|
| 6,019,466 A | | 2/2000 | Hermanson | 347/104 |
| 6,106,094 A | | 8/2000 | Otani et al. | 347/19 |
| 6,189,991 B1 | | 2/2001 | Wen et al. | 347/13 |
| 6,457,800 B1 | * | 10/2002 | Bohm et al. | 347/19 |

FOREIGN PATENT DOCUMENTS

| | | |
|---|---|---|
| EP | 0 539 812 A2 | 5/1993 |
| EP | 0 571 804 A2 | 12/1993 |
| EP | 0 813 971 A2 | 12/1997 |
| EP | 0 938 973 A2 | 9/1999 |
| JP | 11240204 | 9/1999 |

OTHER PUBLICATIONS

European Search Report, EP 01 00 0045, Jun. 2001.

* cited by examiner

*Primary Examiner*—Lamson Nguyen
(74) *Attorney, Agent, or Firm*—John A. Merecki; Hoffman, Warnick & D'Alessandro

(57) ABSTRACT

An ink-jet printer includes pagewidth printheads mounted in a frame, wherein the printheads are coupled to mechanical devices for aligning the printheads with respect to each other, with respect to an edge of the image receiving substrate, or with respect to both. The printer may include devices for sensing the possible misalignment, coupled to a computer for automatically aligning the printheads.

10 Claims, 6 Drawing Sheets

INK-JET PRINTER EQUIPPED FOR ALIGNING THE PRINTHEADS

The application claims the benefit of U.S. Provisional Application No. 60/292,582 filed on May 22, 2001.

FIELD OF THE INVENTION

This invention relates to an ink-jet printer with at least page-wide printhead structures and especially to a system for aligning these printhead structures with respect to each other and the image receiving substrate.

BACKGROUND OF THE INVENTION

Ink-jet printing has become a widely used printing technique especially in the digitally controlled electronic printing business.

Many types of ink-jet printing mechanisms have been invented. These can be categorised as either continuous inkjet (CIJ) or drop on demand (DOD) ink-jet. Using one of these type of ink-jet printing, colour printers have been designed, wherein from multiple printhead structures different colours are printed. Properly controlling the arrangement of various droplets of ink of different colours will result in a wide spectrum of perceivable colours. The clarity and quality of the resultant image is affected by the accuracy of the placement of the ink droplets on the medium. Printers which use multiple printhead structures to co-operatively form a single image usually require mechanical or electronic adjustment so that ink droplets printed by one printhead alight at precise locations on the receiving medium relative to those printed by another printhead in the printer. Several methods to achieve the accurate alignment of the rows of droplets ejected by the different printhead structures have been proposed.

For example, in U.S. Pat. No. 5,600,350 titled Multiple Inkjet Print Cartridge Alignment By Scanning A Reference Pattern And Sampling Same With Reference To A Position Encoder, U.S. Pat. No. 5,448,269 titled Multiple Inkjet Print Cartridge Alignment For Bi-directional Printing By Scanning A Reference Pattern, U.S. Pat. No. 5,451,990 titled Reference Pattern For Use In Aligning Multiple Inkjet Cartridge, U.S. Pat. No. 5,404,020 titled Phase Plate Design For Aligning Multiple Inkjet Cartridges By Scanning A Reference Pattern, U.S. Pat. No. 5,350,929 titled Alignment System For Multiple Colour Pen Cartridges, U.S. Pat. No. 5,297,017 titled Print Cartridge Alignment In Paper Axis, and U.S. Pat. No. 5,250,956 titled Print Cartridge Bi-directional Alignment In U.S. Pat. No. 5,534,895 the ink-jet printer is equipped with a source of illumination that is passed across a test pattern having features indicative of printhead structure alignment and discernible under the illumination. The source of illumination is connected to circuitry that determines the variation in light intensity of the test pattern. A value indicative of the misalignment is calculated and used to correct the timing of firing signals between the sequentially fired banks of nozzles of a printbar.

In U.S. Pat. No. 5,751,305 it is disclosed to place a referencing mechanism on the printer and a detector on the printhead in order to dynamically align one or more printheads in a printer. The printhead structure is moved at a known speed past two spaced apart reference indicia of the referencing mechanism. The passing of a first of the spaced apart reference indicia is detected and the passing of a second of the spaced apart reference indicia is detected. The time between the detection of the first reference indicia passage and the detection of the second reference indicia passage is measured and a delay time, related to the measured period of time, is created. Energization of an ink drop ejection is delayed for the duration of the delay time.

In U.S. Pat. No. 5,192,959 an alignment system for a pagewide printhead structure is disclosed. The pagewidth printhead structure would include a reference plate, a linear array of ink jet sub-units affixed to the reference plate, and a plurality of alignment sub-units affixed on opposite ends of the planar surface of said reference plate. The ink jet printer would also include alignment or reference points for engaging the alignment sub-units and thereby aligning the pagewidth printhead structure with respect to the frame. However once the printhead structure is aligned in the frame no further fine tuning of the alignment is foreseen.

In U.S. Pat. No. 6,109,721 a bi-directional print position alignment system for automatically aligning bi-directional printing position of a printhead structure in a serial printer as a function of high sensor accuracy and clock frequency of a CPU controlling the sensor. The alignment system includes a sensing section for sensing a position of a printhead structure for vertical alignment, a misalignment detecting section for detecting mechanical misalignment of the printhead structure, and a printing section for correcting said mechanical misalignment of the printhead structure and printing information on a printable medium after said mechanical misalignment of the printhead structure is corrected.

In U.S. Pat. No. 6,109,722 and U.S. Pat. No. 6,076,915 test patterns are disclosed that are useful for printhead structure alignment. The test patterns are optically sensed and the sensed pattern are used to electronically adjust the alignment, either by adjusting the firing time of the nozzles, either by shifting the pattern of ink-jet nozzles from which the ink is ejected.

Although the teachings of the prior art do allow for a good alignment of printhead structures, it is still desired to have a system for printhead structure alignment that makes it possible to align in more than one direction and/or over a fraction of the nozzle pitch.

SUMMARY OF THE INVENTION

The present invention is a method for aligning printhead structures in an ink-jet printer as claimed in independent claim 7, and a system in which the method is implemented as claimed in independent claim 1. Preferred embodiments of the invention are set out in the dependent claims.

Advantages and further embodiments of the present invention will become apparent from the following description and drawings.

DETAILED DESCRIPTION OF THE INVENTION

Figure 1:
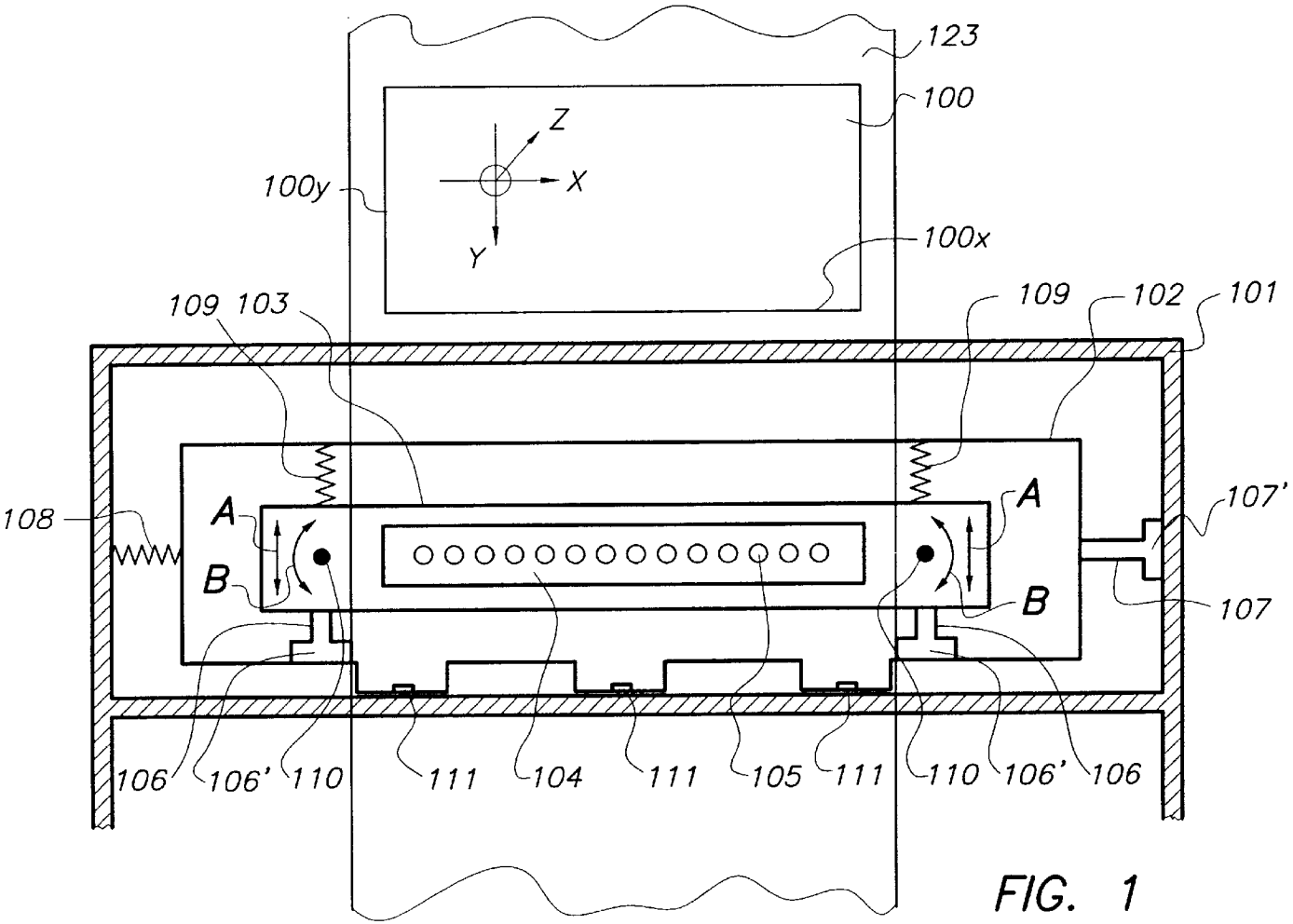
FIG. 1 shows schematically an embodiment of an ink jet printer with printhead structures equipped for being mechanically aligned (for sake of clarity only one printhead structure is shown).

It is in any ink jet printer comprising more than one printhead structure desirable to have means and ways of aligning the printhead structures with respect to each other and to the edge of the image receiving member. In the printing business the trend to replace or supplement classical (e.g. offset) printing by digital printing techniques (e.g. electrostatic printing or ink jet printing) is still growing. Due to this trend the demands on ink jet printing have risen to higher standards than those demanded for SOHO (small office/home office) printing. Especially the registration of different colour images in the print has to be very good. In digital printing with ink jet printers in order to replace or supplement classical (e.g. offset) printing page wide printheads are frequently used. In such printers it is highly desired to have the possibility to align the printheads—at least with respect to each other, preferably also with respect to one or more of the edges of the image receiving substrate—in a simple way that does not pose (too) high demands on the computing power of the computer that drives the printer Therefore in an ink jet printer wherein at least two different printhead structures are mounted in a frame, each of the printhead structures is coupled to at least one mechanical means for aligning the nozzles of said at least two different printhead structures in at least one of the x- and y-direction.

A mechanical alignment of the nozzles in the print direction (y-direction) forgoes the adaptation of the firing time of each individual nozzle to the degree of parallelism between the nozzles of two different print heads and/or to the difference in distance between the nozzle arrays. This mechanical alignment has the advantage that the computing power during printing can be lower. This advantage is most pronounced in a printer that comprises multiple printhead structures, e.g., six—four for the YMCK printing and two for further supporting colours—because in such printer the alignment of the nozzles of the six different printhead structures based on adjustment of the firing time demands very much of the computing power and on the electronics of the printhead. Even if the computing power can be provided, it can be impossible to adjust the firing time of each individual nozzle due to limitations in the electronics of the printhead.

A mechanical alignment in the x-direction, i.e. the possibility of mechanically displacing the nozzles of the different printhead structure in a direction perpendicular to the print direction has the advantage that mechanical means can be introduced so that the displacement of the nozzles can be effected over a fraction of the nozzle pitch, whereas in prior art embodiment for alignment in the x-direction, a "displacement" was always disclosed to go over an integer number of nozzle pitches.

Preferably in an ink jet printer according to this invention, wherein at least two different printhead structures are mounted in a frame, each of the printhead structures is coupled to at least one mechanical means for aligning the nozzles of said at least two different printhead structures in both said y- and x-direction.

In FIG. 1, a first embodiment of an ink jet printer according to this invention is schematically shown. For sake of clarity, only one printhead structure is shown, it can however easily be appreciated that it is possible to include any desired number of printhead structures in a printer according to this invention. An image receiving substrate (100) with and x-edge (100*x*) and a y-edge (100*y*) is guided by a guiding means (123) past printhead structure (104) with an array of nozzles (105). The guiding means and the image receiving substrate are shown as being transparent for sake of clarity. The printhead structure (104) is mounted in an y-frame (103) so that the array of nozzles defines an x-direction, perpendicular to the print direction, that defines an y-direction. The y-frame (103) is mounted in an x-frame (102) by attachments (110) so that it can be moved in a direction parallel to the print direction (arrows A) and/or that it can get an angular movement (arrows B) with respect to the x-frame. Therefore on both ends of the end of the y-frame a linear actuator (106) coupled to a stepping motor (106') is mounted in contact with the y-frame and the x-frame. Opposite to each of the actuators (106) a play spring (109) is present to avoid play of the printhead structure in the y-direction, once it is aligned. The x-frame (102) is mounted in a master frame (101) by fastening means (111), that allow for sliding movement in the x-direction. At a side of the x-frame parallel with the x-direction, a linear actuator (107) coupled to a stepping motor (107') is mounted in contact with the x-frame (102) and the master frame (101). A play spring (108) is mounted opposite to the linear actuator (107) to avoid play of the printhead structure in the x-direction, once it is aligned.

When the attachment points (110) of the y-frame are designed so as to allow for movement both in the direction of arrows A and of arrows B, then an actuation of the actuators (106) in the same direction and over the same distance will cause the y-frame (and thus the printhead structure coupled to it) to be displaced in the y-direction and an actuation of the actuators (106) in opposite directions or actuation of only one actuator will cause the y-frame to rotate. With the first type of actuation the distances between different printhead structures are changed, by the second type of actuation the parallelism of different printhead structures with respect to each other and/or with respect to the x-edge (100*x*) of the image receiving substrate is changed. It will be self-evident for the person skilled in the art that it is possible to design the attachment points of the y-frame (110) so as to allow only for a movement according to arrows A, or only for a movement according to arrows B or for allowing movement according to both arrows A and arrows B.

Figure 2:
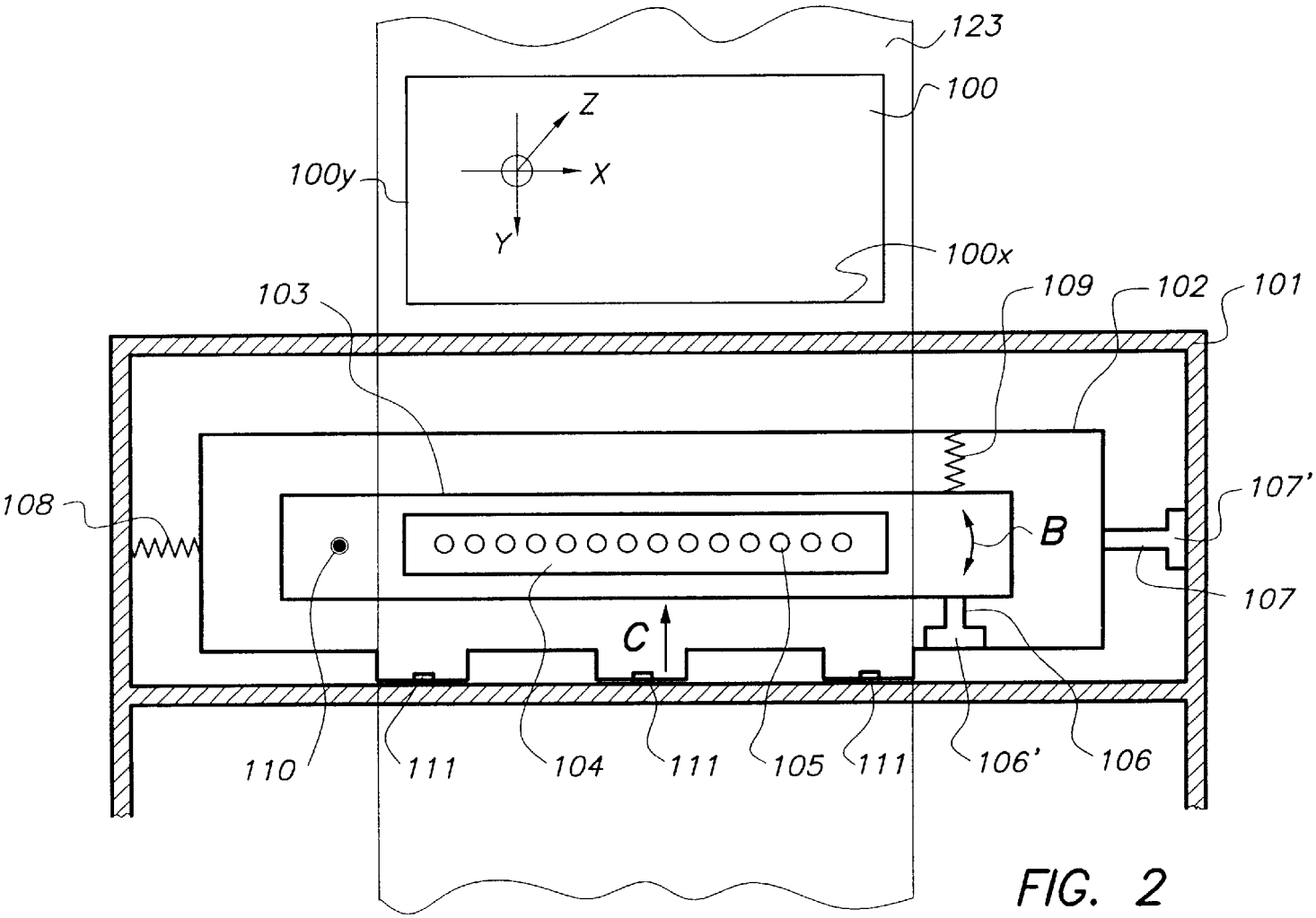
FIG. 2 shows schematically another embodiment of an ink jet printer with printhead structures equipped for being mechanically aligned (for sake of clarity only one printhead structure is shown).

In FIG. 2 a second embodiment of an ink jet printer according to this invention is very schematically shown. In this figure the schematically shown ink jet printer comprises only one printhead structure, it is however clear that it is possible to include any desired number of printhead structures in a printer according to this invention. An image receiving substrate (100) with and x-edge (100*x*) and a y-edge (100*y*) is guided by a guiding means (123) past printhead structure (104) with an array of nozzles (105). The guiding means and the image receiving substrate are shown as being transparent for sake of clarity. The printhead structure (104) is mounted in an y-frame (103) so that the array of nozzles defines an x-direction, perpendicular to the print direction, that defines an y direction. The y-frame (103) is mounted in an x-frame (102) so that it can rotate around an axis (110) located at one end of the printhead structure (104). At the end of the printhead structure opposite to the axis (110) a linear actuator (106) coupled to a stepping motor (106') is mounted in contact with the y-frame and the x-frame. Actuation of the actuator 106 causes the y-frame to rotate around axis 110 and thus to move in the direction of arrow B. A play spring (109) is present to avoid play of the printhead structure in the y-direction, once it is aligned. The x-frame (102) is mounted in a master frame (101) by fastening means (111), that allow for a sliding movement in the x-direction. At a side of the x-frame parallel with the x-direction, a linear actuator (107) is coupled to a stepping motor (107') is mounted in contact with the x-frame (102) and the master frame (101). A play spring (108) is mounted opposite to the linear actuator (107) to avoid play of the printhead structure in the x-direction, once it is aligned. In this embodiment of a printer of this invention, the mechanical alignment of the nozzles in the print direction (y-direction) is only an alignment wherein the parallelism of different printhead structures with respect to each other and/or with respect to the x-edge (100*x*) of the image receiving substrate is changed. Thus, the possibility of y-alignment in this second embodiment forgoes the need for adapting the firing time of each individual nozzle to the degree of parallelism between the nozzles of two different printhead structures. Since the distance between the different printheads is then not mechanically adjusted, (simplifying the design of the mechanical means for y-alignment), it may be necessary to adjust the firing time for at least one of the printhead structures, or for each of the printhead structures, taking in account the difference in the distance between them. This adjustment is however much less complicated than an adjustment of the firing time of each individual nozzle and gives thus still a considerable reduction of the computing power needed.

Figure 3:
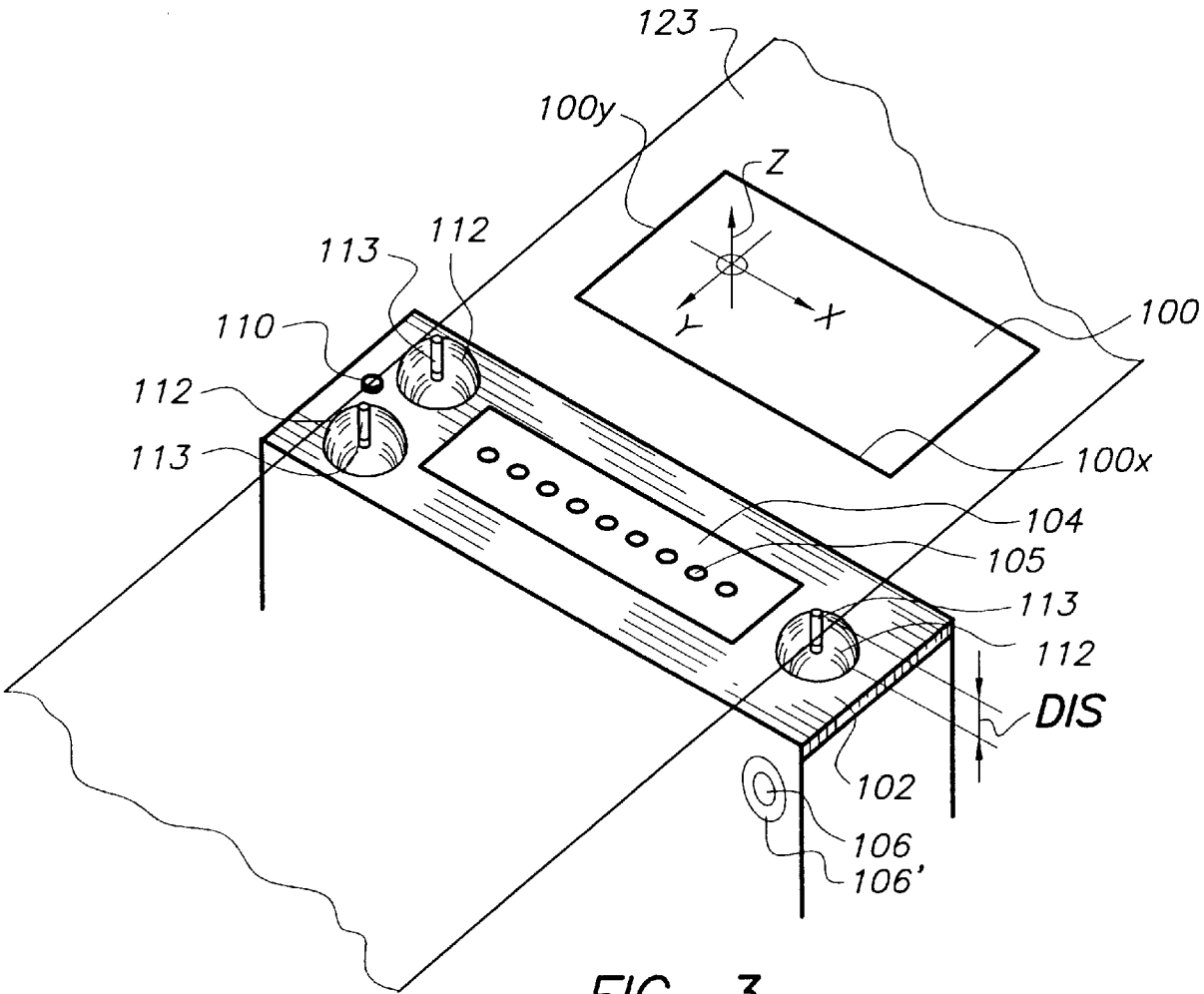
FIG. 3 shows schematically a printer with means for adjusting the distance between the printhead structures and the image receiving substrate.

An ink jet printer according to the present invention can beneficially further include spacing means for keeping the distance between the printhead structures and the image receiving substrate constant (i.e. for keeping the distance in the z-direction constant). If so desired, these spacing means can include movable parts coupled to means for adjusting the distance in the z-direction. In that case it is possible to adjust the distance in the z-direction according to the thickness of the image receiving substrate, so that a printer can be built wherein image receiving substrates showing a large variety of thickness can be used and the printer can be adjusted to the thickness of the substrate used, so as to have an optimal "throw distance" (i.e. the distance between the nozzle array and the image receiving substrate) for every substrate thickness. A possible placement of the spacing means for keeping the distance between the printhead structures and the image receiving substrate constant (i.e. for keeping the distance in the z-direction constant) is schematically shown in FIG. 3. This figure is a view of the printer in FIG. 2 along arrow C. In this figure the y-frame (102) is shown together with the printhead structure (104) with nozzles (105) coupled to it. The axis 110 around which the y-frame can rotate upon actuation of actuator (106) by a stepping motor (106') is also shown. The y-frame carries on the side of it facing the guiding means (123) for guiding an image receiving substrate past the printhead structure (104) a number of spacers (e.g. three spacers) (112) each of the spacers having a movable part (113). Both the guiding means and the image receiving substrate are shown as being transparent. The movable part (113) of the spacing means is in contact with the guiding means (123) and keeps thus the distance, DIS, between y-frame and guiding means constant. By moving the movable parts (113) of the spacing means (112) in the z-direction, the distance, DIS, can be changed so as to keep an optimum "throw distance" when the thickness of the image receiving substrate is changed. In FIG. 3 the spacing means (112) for keeping the distance between the printhead structures and the image receiving substrate constant are shown as being present on the side of the y-frame (102) facing the guiding means (123) and as including a movable part (113). It is clear that the purpose of the spacing means for keeping the distance between the printhead structures and the image receiving substrate constant can be achieved in other configurations. E.g., it is possible to have spacing means, not including a movable part, between the master frame (101) and the guiding means (123) for the image receiving substrate. Then the y-frame is coupled to the x-frame in such a way that it not only can be moved for adjusting the y-position of it, but also for adjusting the z-position. When the y-frame is coupled to the x-frame in this way, mechanical means, e.g., linear actuators, for moving the y-frame in the z-direction can be incorporated between the x- and y-frame.

It is also possible, if so desired, to equip a printer of this invention with spacing means, not including a movable part, between the master frame (101) and the guiding means (123) for the image receiving substrate. Then the x-frame is coupled to the master frame in such a way that it not only can be moved for adjusting the x-position of it, but also for adjusting the z-position. When the x-frame is coupled to the master frame in this way, mechanical means, e.g., linear actuators, for moving the x-frame in the z-direction can be incorporated between the master frame and the x-frame.

Preferably the mechanical means for adjusting the printhead structures in the y-, x- and, if so desired, in the z-direction are linear actuators. The linear actuators are preferably adjusted so as to be able to displace the printhead structures over a distance between about 1 $\mu$m and about 10 mm. The linear actuators are preferably construed so as to allow for an alignment that is adapted to the nozzle pitch of the nozzle arrays in the printhead. The linear actuators are preferably designed so as to allow an alignment—i.e. a displacement of the printheads—in steps as small as 1/20th of the nozzle pitch. Linear actuators allowing for a displacement in steps as small as 1/10th of the nozzle pitch can however also be beneficially used when high accuracy of the alignment is desired. Thus in a printer according to this invention,—depending on the accuracy of alignment that is desired —linear actuators allowing for a displacement of the printheads in steps between 1 to 100 $\mu$m (both limits included) can beneficially be used. Preferably linear actuators allowing for a displacement (alignment) in steps between 2 and 50 $\mu$m are used. E.g. a 720 dpi printer has a nozzle pitch of 35 $\mu$m. Thus when using linear actuators allowing for an alignment in steps of 3 $\mu$m, it is possible to align the printhead structures in a 720 dpi printer to 1/10 of the nozzle pitch. E.g. in a 250 dpi printer, the nozzle pitch is 100 $\mu$m, thus when using linear actuators allowing for displacement in steps of 50 $\mu$m, it is possible to align the printhead structures in a 250 dpi to ½ of the nozzle pitch.

The actuators can be manually driven, e.g. it can be micrometer screws or can, preferably, be powered by stepping motors. In the latter case the linear actuators are preferably the spindles of the stepping motors.

When micrometer screws are used for the displacement (alignment) of the printheads, it is preferred to use—in a printer of this invention—micrometer screws allowing for a displacement accuracy of the printheads between 1 to 100 $\mu$m (both limits included). Preferably micrometer screws allowing for a displacement (alignment) accuracy between 2 and 50 μm are used.

When the spindles of the stepping motors are the linear actuators coupled to the stepping motors, then the combination of the step of the stepping motor and the pitch of the spindles is preferably adapted to the nozzle pitch of the printhead. Thus, stepping motors for use in an ink jet printer of this invention have preferably a combination of motor step and spindle pitch so that a linear displacement in steps between 1 μm and 100 μm (both limits included), more preferably in steps between 2 μm and 50 μm (both limits included) are possible.

It is possible, if so desired, to use—in a printer according to this invention—stepping motors with a rather large linear displacement step due to either limited number of steps per rotation of the motor or rather large pitch of the spindle, and electronically create smaller steps, via so called "micro stepping". This can have the advantage of using motors that are less expensive and still proceed with a displacement of the printheads in equally small steps than with motors having a small step and including a spindle with a small pitch. Whatever the method that is used for displacing the printheads—and thus the nozzle arrays contained in them—it is important that the displacement can proceed in steps between 1 μm and 100 μm (both limits included), more preferably in steps between 2 μm and 50 μm (both limits included).

Possible misalignment of the printheads can be detected off-line. E.g. A template of a test image can provided with the printer. The operator of the printer can then compare an actual print of the test image on the printer with the target output as shown in a template of the test image. If the operator detects misalignment—i.e. differences between the print of the test image and the template of it—he can either manually adjusts the micrometer screws to align the printheads so as to have an actual output corresponding to the target output or he can activate the stepping motors to align the printheads. It is also possible to scan the printed (actual) test image with an optical scanner and to input the scanned data into a computer memory, wherein the target data, if so desired with tolerances, for the test image are saved. The computer can then compare the data of the actual test image with the target data and e.g. display the differences on a screen. Based on the figures presented on the screen, the operator of the printer either adjusts the micrometer screws or actuates the stepping motors. It is however also possible to couple the computer wherein the actual data of the test image are compared with the target data to the stepping motors that can the automatically be actuated to adjust the alignment.

Preferably the possible misalignment of printheads in a printer of this invention is automatically detected on the printer and then either manually or automatically corrected. Therefore, an ink jet printer according to this invention is preferably further equipped with means for sensing the relative position of the printhead structures with respect to each other. In a still further preferred embodiment an ink jet printer according to this invention is equipped with means for sensing the relative position of the printhead structures not only with respect to each other, but also with respect to one or more edges of the image receiving substrate. The means for sensing the relative position of the printhead structures and/or the edge(s) of the image receiving member can beneficially be optical means, e.g. CCD-cameras, that are placed in the printer such as to read a printed test image and/or the edges of the images receiving substrate. In this way possible misalignments between the nozzles of the different printhead structures and/or the edge of the paper are detected. The means for sensing the position of the printhead structures can be coupled to a computer so as to compare the actual data of the test image with the target data and to display the degree of misalignment on the computer screen. An operator of the printer then reads this information and actuates the linear actuators for aligning the printhead structures. In a very preferred embodiment the computers wherein the target positions and tolerances thereon in the y-, x- and, if so desired, the z-direction, are stored and these values are compared with the actual values sensed by the sensing means, is further coupled to stepping motors for actuating the linear actuators automatically to a degree depending on the difference between actual positions sensed by the means for sensing the position of the printhead structures and the target positions. In this way the alignment can proceed automatically.

The invention further encompasses a method for aligning printhead structures in an ink jet printer comprising the steps of

- providing an image receiving substrate with an x- and a y-edge,
- printing a test image on an image receiving substrate for testing a y-alignment and of an x-alignment of said printhead structures, creating actual data from said test image,
- comparing said actual data with target data concerning said y- and x-alignment of said printhead structures and
- actuating mechanical actuators for aligning said printhead structures according to said target values.

Preferably after the step of printing a test image, a further step of sensing the actual data of the test image with optical sensors is inserted.

More preferably, in said step of sensing the test image, also a y-edge and/or an x-edge of said image receiving substrate is sensed.

It is possible in a method according to this invention to align the printheads only with respect to each other, but in a very preferred embodiment of a method according to this invention a step of sensing the edge of the image receiving substrate that is substantially orthogonal to the print direction (herein after called "x-edge") and/or a step of sensing one of the edges of the image receiving substrate that is substantially parallel to the print direction (herein after called "y-edge") is included, then the printheads can be aligned with respect to each other and to an edge of the image receiving substrate.

In a highly preferred embodiment of a method of this invention, said actual data of the test image sensed with optical sensors are sent to a computer memory and said step of comparing the actual data with target data is executed in said computer memory. In the most preferred embodiment of the invention said computer wherein the actual data are compared with target data is also coupled to the mechanical actuators and when in said computer a difference between the actual data and the target data of the test image is found, the computer automatically executes the step of actuating the mechanical actuators.

Figure 4:
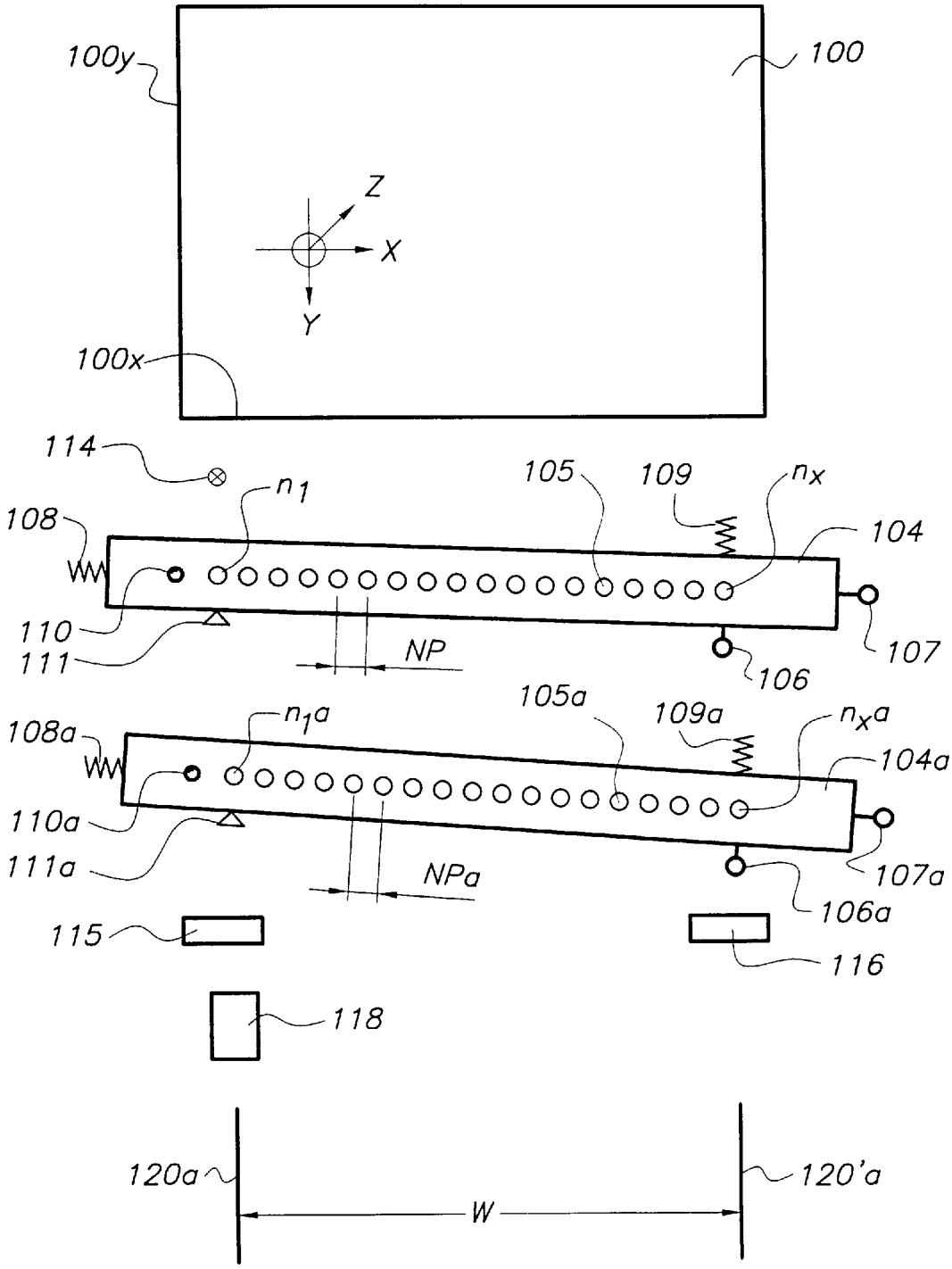
FIGS. 4 and 5 show schematically a printer incorporating optical sensors for sensing a test image together with a first (FIG. 4) and second stage (FIG. 5) of a possible implementation of a method for aligning printhead structures in a printer according to this invention.
Figure 5:
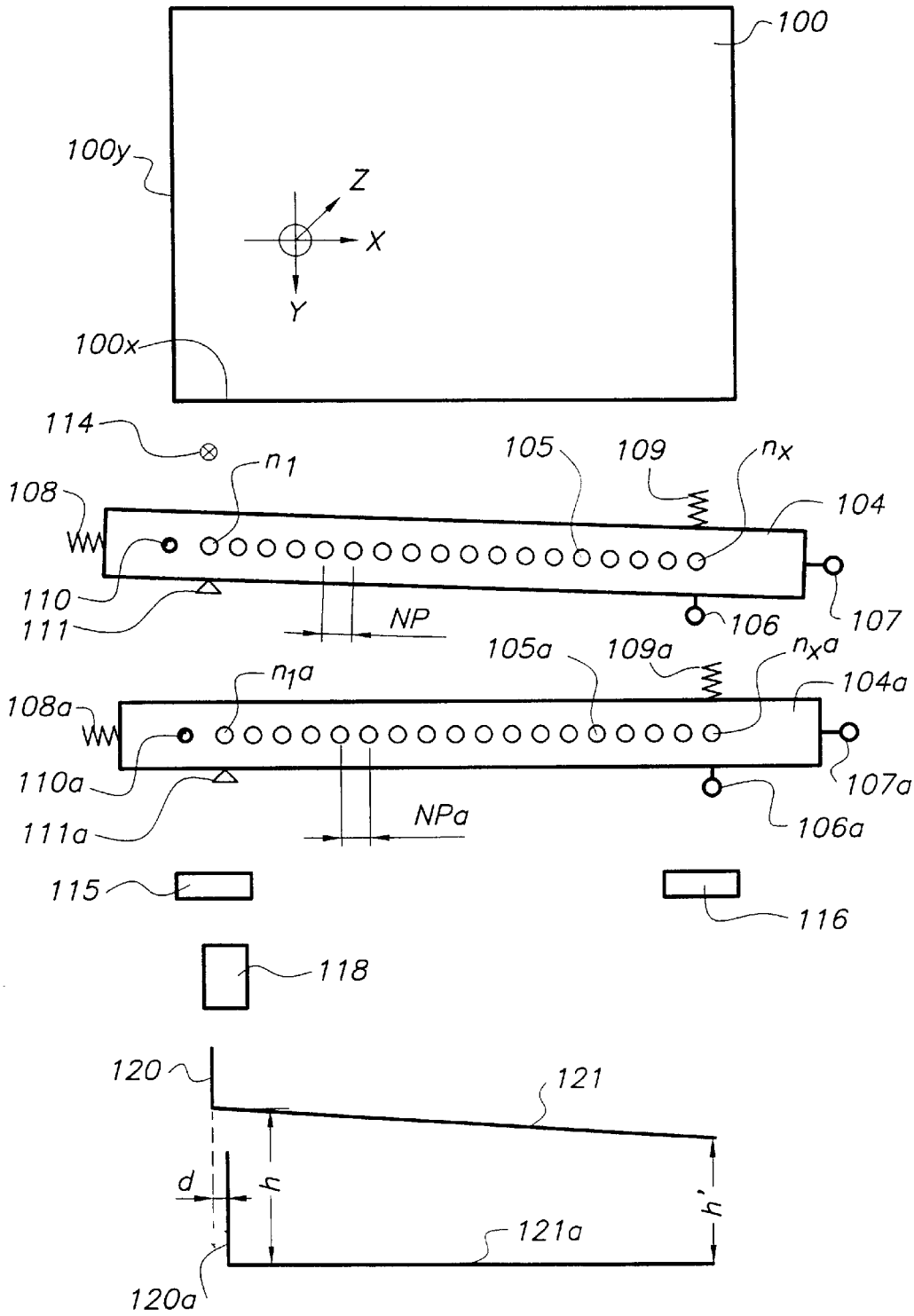

A printer according to this invention incorporating optical sensors for sensing a test image together with a first stage of a possible implementation of a method for aligning the printhead structures is shown in FIG. 4. In FIG. 4 two printhead structures (104 and 104*a*) are schematically shown. In both printhead structures the same numericals as in FIGS. 1 to 3 are used for designating the same parts of the printhead structure, the numericals of the second printhead structure have been provided with the letter "a". For sake of clarity the printer, shown in FIG. 1, is further schematised in this FIG. 4. In FIG. 4 the master frame and the x- and y-frames and the spacers are omitted for clarity and the FIG. 4 shows two printhead structures (104, 104*a*) each with an array of nozzles (105, 105*a*), the array of nozzles (105) in the printhead (104) has a number of nozzles $n_1$ to $n_X$, the array of nozzles (105*a*) in the printhead (104*a*) has a number of nozzles $n_1$a to $n_X$a. Both printhead structures are coupled to linear actuators (106, 106*a*, 107, 107*a*) for aligning them in the y- and x-direction respectively. Play springs (108, 108*a*, 109, 109*a*) are placed in the printer so as to press the printhead structures firmly against the linear actuators. The printhead structure can rotate around an axis (110, 110*a*) and are supported in the x-direction by fastening means (111, 111*a*) leaving the possibility for sliding the printhead structures in the x-direction. The printhead structures are shown as deviating from the target position, in the x-direction the deviation is half the nozzle pitch (NP, NPa) and in the y-direction the non-parallelism of the printhead structures is exaggerated for sake of clarity. An image receiving substrate (100) with y- edges (100*y*) and an x-edge (100*x*) passes the printhead structures in the y-direction. A sensor (114) senses the arrival of the image receiving substrate in the printing zone and signals the arrival of the image receiving substrate so as to start the printing. Two lines (120*a*, 120'*a*) substantially parallel to the y-edge of the image receiving substrate are printed using the first nozzle ($n_1$a) and the last nozzle ($n_X$a) of printhead 104*a*. Then the image receiving substrate passes image sensors (115 and 116) so that the lines 120*a* and 120'*a*, printed by the first printhead structure (104*a*) are sensed and a distance, w, between both lines is detected. When the printhead is orthogonal to the y-direction this distance, w, equals ($n_X$a−1)NPa, the target value for distance, $w_{tar}$. The actual distance w is then compared with the target distance $w_{tar}$. When a difference is observed, the mechanical actuator 106*a* is actuated so as to displace the printhead 104*a* perpendicular to the y-direction. This situation is shown in FIG. 5, where printhead 104*a* is placed perpendicular to the y-direction In a second stage both printhead structures (104, 104*a*) print a line (121, 121*a*) substantially parallel to the x-edge of the image receiving substrate and a line (120, 120*a*) substantially parallel to the y-edge of the image receiving substrate. The image receiving substrate passes again image sensors (115 and 116) so that the line 121*a*, printed by the first printhead structure (104*a*) is sensed first and the line 121 printed by the second printhead structure (104) is sensed secondly. The time difference between the passage of line 121*a* and the passage of line 121 under sensor 115 and under sensor 116 is measured, this translates in a distance between lines 121*a*, and 121 at sensor 115 of h and in a distance between lines 121*a*, and 121 at sensor 116 of h'. If h−h' 0, then the actuator 106 is actuated for adjusting h and h' so that h−h'=0. The lines 120 and 120*a* are sensed by the sensor 118, and it is determined if both lines are in line, if a difference, d is found, then the actuators, 107 and 107*a* are actuated for bringing both lines, 120 and 120*a* in line. It is preferred that the alignment proceeds first to bring the printhead structures parallel to each other (y-alignment) and that then the printhead structures are aligned in the x-direction. Although the method has been explained with only 2 printhead structures, it is clear that the method can be used for aligning more than two printhead structures, e.g., when the first two printhead structures are aligned, then the third is aligned with reference to the already aligned printhead structures and so on until all printhead structures are aligned with respect to each other.

Figure 6:
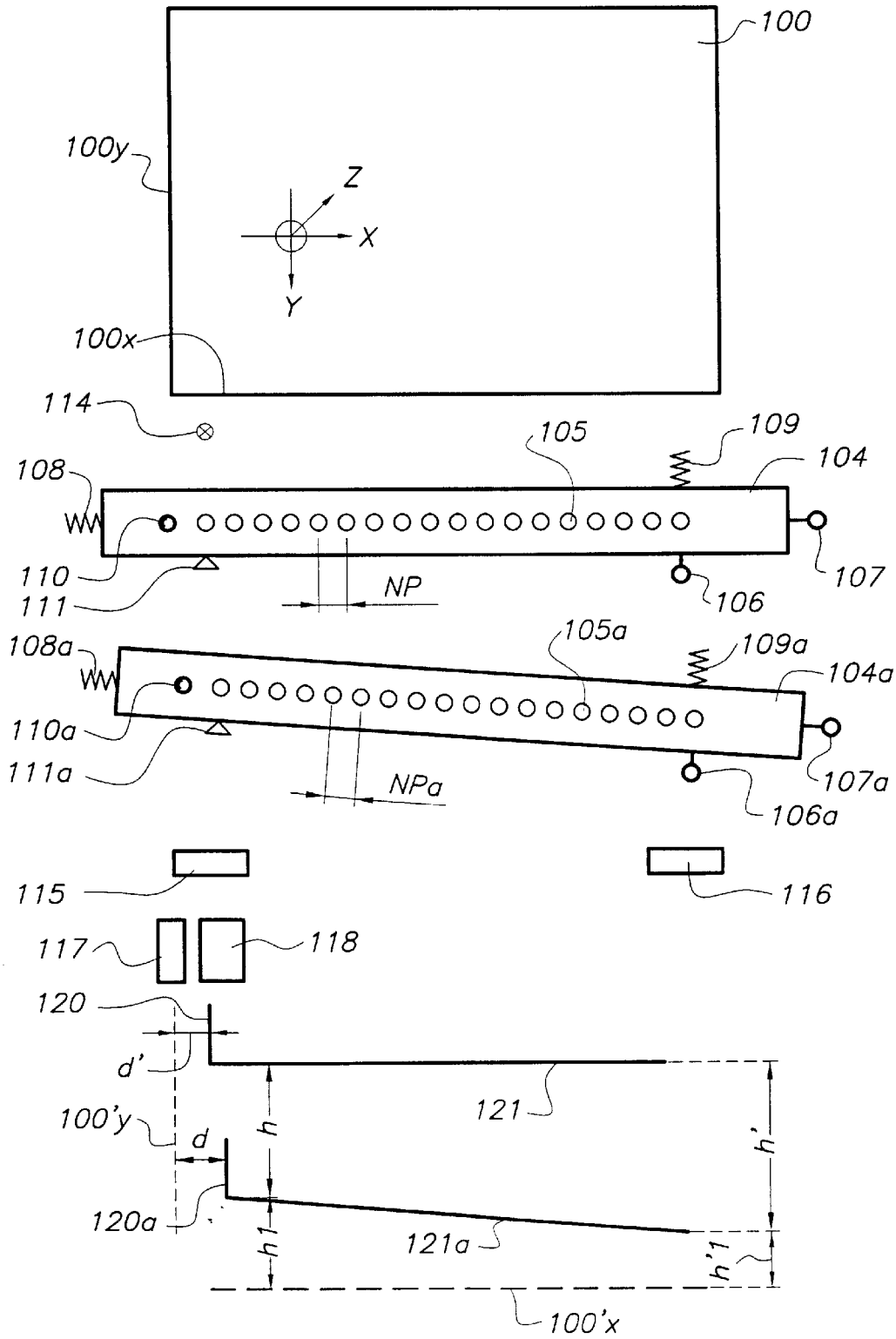
FIG. 6 shows schematically a printer incorporating optical sensors for sensing a test image together with a further possible implementation of a method for aligning printhead structures in a printer according to this invention.

Using FIG. 6, a further implementation of the method of this invention is shown, wherein the printhead structures are aligned with respect to the edges of the image receiving substrate. The figure is basically the same as FIGS. 4 and 5, both printhead structures (104, 104*a*) print a line (121, 121*a*) substantially parallel to the x-edge of the image receiving substrate and a line (120, 120*a*) substantially parallel to the y-edge of the image receiving substrate. The image receiving substrate passes image sensors (115 and 116) so that the x-edge of the image receiving substrate is sensed (see dashed line 100'x). The sensors 115 and 116 sense the line 121*a*, printed by the first printhead structure (104*a*). The time difference between the passage of x-edge of the image receiving substrate and the passage of line 121*a* under sensor 115 and under sensor 116 is measured, this translates in a distance between the x-edge of the image receiving substrate and line 121*a* at sensor 115 of h1 and in a distance between the x-edge of the image receiving substrate and line 121*a*, at sensor 116 of h'1. If h1−h'1 0, then the actuator 106*a* is actuated for adjusting h1 and h'1 so that h1−h'1=0. Then the sensors 115 and 116 sense also the line 121 printed by the second printhead structure (104). The time difference between the passage of x-edge of the image receiving substrate and the passage of line 121 under sensor 115 and under sensor 116 is measured, this translates in a distance between the x-edge of the image receiving substrate and line 121 at sensor 115 of (h1+h) and in a distance between the x-edge of the image receiving substrate and line 121, at sensor 116 of (h'1+h'). When (h1+h)—(h'1+h') 0 linear actuator 106 is actuated to adjust the distances so that (h1+h)−(h'1+h')=0. Sensor 117 senses an y-edge (100'*y*) of the image receiving substrate. The lines 120 and 120*a* are sensed by the sensor 118, and it is determined if both lines are at the same distance from the y-edge of the image receiving substrate. If d' d, then the actuators, 107 and 107*a* are actuated for bringing both lines, 120 and 120*a* in line. It is preferred that the alignment proceeds first to bring the printhead structures parallel to each other (y-alignment) and that then the printhead structures are aligned in the x-direction.

Although the method has been explained with only 2 printhead structures, it is clear that the method can be used for aligning more than two printhead structures, e.g., when the first two printhead structures are aligned with respect of the edges of the image receiving substrate, then the third is aligned with reference to the already aligned printhead structures and so on until all printhead structures are aligned with respect to each other and with respect to the edges of the image receiving substrate. Although the method according to this invention has been explained with the use of 3 sensors (FIGS. 4 and 5), 4 sensors (FIG. 6), the number of optical sensors is basically determined by the quality of alignment of the printhead structures that is desired. When e.g. only the parallelism between the printhead structures is deemed necessary, then the method of this invention can be executed with only two sensors, e.g., sensors 115 and 116. The sensors as shown in FIGS. 4, 5 and 6 have a certain range so as to be able to sense lines that are a number of nozzle pitches apart and have a resolution as to be able to sense a misalignment of at least one tenth of the nozzle pitch NP. It is however possible to execute a method according to this invention using smaller sensors that , e.g., are designed to sense over the width of a nozzle pitch when these are placed in close proximity.

Having described in detail preferred embodiments of the current invention, it will now be apparent to those skilled in the art that numerous modifications can be made therein without departing from the scope of the invention as defined in the appending claims.

Parts List

100 Image receiving substrate
100*x*, 100*y*: x- and y-edge of the image receiving substrate
101 Master frame
102, 102*a* x-frame
103, 103*a* y-frame
104, 104*a* printhead structure.
105, 105*a* nozzle array
106, 106*a* linear actuator for alignment in the y-direction
107, 107, linear actuator for alignment in the x-direction
108, 108*a*, 109, 109*a*: anti play springs
110, 110*a* attachment and pivoting point in the y-frame
111, 111*a* attachment points of the x-frame to the master frame
112, 112*a* spacing means between the printhead structures and the image receiving substrate
113, 113*a* movable parts in the spacing means for aligning in the z-direction
114 sensor of x-edge of the image receiving substrate
115, 116 sensors for sensing the x-edge of the image receiving substrate and for sensing the test image
117, 119 sensor for sensing a y-edge of the image receiving substrate
118 sensor for sensing the test image
123 guiding means for guiding the image receiving substrate past the printhead structure.

We claim:

1. An ink-jet printer for printing on an image receiving substrate, the ink-jet printer comprising:

a guiding device for guiding said image receiving substrate in a y-direction;

a first x-frame, mounted translatably in a first x-direction;

a first y-frame, mounted in said first x-frame and rotatable around a first axis perpendicular to said first x-direction and perpendicular to said y-direction;

a first printhead structure, mounted in said first y-frame and having a first array of nozzles defining said first x-direction;

a second x-frame, mounted translatably in a second x-direction;

a second y-frame, mounted in said second x-frame and rotatable around a second axis perpendicular to said second x-direction and perpendicular to said y-direction;

a second printhead structure, mounted in said second y-frame and having a second array of nozzles defining said second x-direction;

an adjusting device for adjusting a firing time of at least one of said first array of nozzles and said second array of nozzles.

2. The ink-jet printer according to claim 1, further comprising:

a first actuator for rotating said first y-frame around said first axis;

a second actuator for rotating said second y-frame around said second axis;

a third actuator for translating said first x-frame in said first x-direction;

a fourth actuator for translating said second x-frame in said second x-direction.

3. The ink-jet printer according to claim 2, wherein said third and said fourth actuators allow for a displacement in steps between 2 $\mu$m and 50 $\mu$m, both limits included.

4. The ink-jet printer according to claim 1, further comprising:

a sensor for sensing a test pattern printed on said image receiving substrate by said first and second arrays of nozzles.

5. The ink-jet printer according to claim 2, further comprising:

a sensor for sensing a test pattern printed on said image receiving substrate by said first and second arrays of nozzles.

6. The ink-jet printer according to claim 4, wherein said sensor is coupled to a computer for detecting a difference between a sensed position and a target position, stored in a memory of said computer, of said first printhead structure with respect to said second printhead structure.

7. The ink-jet printer according to claim 5, wherein said sensor is coupled to a computer for detecting a difference between a sensed position and a target position, stored in a memory of said computer, of said first printhead structure with respect to said second printhead structure.

8. A method for aligning a first and a second printhead structure in an ink-jet printer, wherein said first printhead structure comprises a first array of nozzles and said second printhead structure comprises a second array of nozzles, the method comprising:

guiding an image receiving substrate in a y-direction;

printing a test pattern by said first and second arrays of nozzles on said image receiving substrate;

sensing said test pattern, thus obtaining actual alignment data of said first and second printhead structures;

comparing said actual alignment data with target alignment data;

and, based on said comparison:

translating a first x-frame in a first x-direction defined by said first array of nozzles;

rotating a first y-frame around a first axis perpendicular to said first x-direction and perpendicular to said y-direction, wherein said first printhead structure is mounted in said first y-frame and wherein said first y-frame is mounted in said first x-frame;

translating a second x-frame in a second x-direction defined by said second array of nozzles;

rotating a second y-frame around a second axis perpendicular to said second x-direction and perpendicular to said y-direction, wherein said second printhead structure is mounted in said second y-frame and wherein said second y-frame is mounted in said second x-frame;

adjusting a firing time of at least one of said first array of nozzles and said second array of nozzles.

9. The method according to claim 8, further comprising:

sensing an edge selected from an x-edge and an y-edge of said image receiving substrate.

10. The method according to claim 9, further comprising:

aligning said first and second printhead structures with respect to said edge.

* * * * *